US005749298A

United States Patent [19]

Castelli et al.

[11] Patent Number: 5,749,298

[45] Date of Patent: May 12, 1998

[54] ARRANGEMENT FOR SECURING A PRINTING BLANKET TO A CYLINDER

[75] Inventors: Francesco Castelli; Gianpietro Invernizzi, both of Lodi; Omar Reale, Crema, all of Italy

[73] Assignee: Reeves Brothers, Inc., Spartanburg, S.C.

[21] Appl. No.: 872,795

[22] Filed: Jun. 10, 1997

[51] Int. Cl.[6] ..... B41F 1/28

[52] U.S. Cl. ..... 101/415.1; 101/376; 428/909

[58] Field of Search ..... 101/415.1, 376; 428/909

[56] References Cited

U.S. PATENT DOCUMENTS

| | | | |
|---|---|---|---|
| 3,802,952 | 4/1974 | Gurin et al. | 161/164 |
| 4,817,527 | 4/1989 | Wouch et al. | 101/389.1 |
| 5,131,326 | 7/1992 | Wrzesinski | 101/415.1 |
| 5,178,068 | 1/1993 | Jughans et al. | 101/415.1 |
| 5,357,863 | 10/1994 | McLean et al. | 101/389.1 |

*Primary Examiner*—Edgar S. Burr
*Assistant Examiner*—Dave A. Ghatt
*Attorney, Agent, or Firm*—Pennie & Edmonds

[57] ABSTRACT

A metal backed printing blanket for mounting on a cylinder that includes a gap. The blanket comprises a metal base plate having top and bottom surfaces and ends which include leading and trailing edges adapted for engaging the cylinder gap. The article further comprises a compressible, elastomeric printing blanket secured to the top surface of the base plate, but not to the ends, and having an upper face adapted for contact transfer of ink to a printable substrate. In addition, the blanket is provided with an anti-slip layer upon at least a portion of the top surface of at least one end of the base plate to facilitate retention of the base plate ends within the gap during rotation of the cylinder. The anti-slip layer has a coefficient of friction that is greater than that of the base plate and a thickness sufficient to permit insertion of the base plate edges and ends into the cylinder gap. In alternate embodiments, the invention is further directed to the method of making the above-described blanket, as well as to a method of securing the blanket to a blanket cylinder in a printing press.

22 Claims, 2 Drawing Sheets

ARRANGEMENT FOR SECURING A PRINTING BLANKET TO A CYLINDER

TECHNICAL FIELD

This invention relates generally to the field of offset printing and more particularly relates to improved printing blankets for use therein, as well as to a method of securing printing blankets to blanket cylinders in offset printing presses.

BACKGROUND OF THE INVENTION

A printing blanket is traditionally used in offset lithography printing to receive an inked image from a printing plate and then to offset or transfer the image to a substrate such as paper. The printing blanket is mounted and secured on a blanket cylinder so that the blanket may receive the image through direct rotary contact with the printing plate, which is mounted on a printing cylinder. The inked image is thus offset from the printing cylinder to the blanket on the blanket cylinder. A substrate, or web, is fed between the blanket cylinder and an impression cylinder. As the printing blanket rotates, it transfers the inked image onto the web.

One common type of printing blanket is typically manufactured as a flat, fabric sheet with an elastomeric surface that is receptive to ink. Such a blanket is mounted by wrapping it around the blanket cylinder. Various means are used to secure the blanket to the cylinder. Typically, the cylinder has a relatively wide gap or groove in its surface (referred to herein as "the cylinder gap"), running in the axial direction, and the leading and trailing ends of the printing blanket are inserted into the gap and secured by any one of a variety of holding devices. Such devices include reel rods and lock-up mechanisms (see, e.g., U.S. Pat. No. 4,870,901 to Norkus), bar supports (see, e.g., U.S. Pat. No. 4,092,923 to Bollmer) and clamps (see, e.g., U.S. Pat. No. 5,329,853 to Dilling and Stegmeir) adapted to grip the ends of the blanket that are inserted into the cylinder gap. The leading and trailing edges of such blankets are generally reinforced with strips of metal, known as "blanket bars", to stiffen the blanket edges and to facilitate insertion of the blanket into the holding device inside the cylinder gap (see, e.g., U.S. Pat. No. 4,090,444 to Stearns).

An important goal in offset printing is to increase the operating speeds of printing presses in order to maximize production. However, high-speed operation increases stresses upon the machinery. In particular, high-speed rotation of a cylinder with a cylinder gap can result in undesirable levels of vibration and shock loading. A cylinder with a gap typically has a mechanism inside the gap for securing the printing blanket to the cylinder, as noted above. Such a mechanism causes the weight of the cylinder to be unevenly distributed about its axis. The resultant eccentric loading increases vibration during high-speed rotation of the cylinder, to the detriment of print quality. Fabric backed printing blankets are particularly susceptible to the deleterious effects of vibrations during high speed operations, such as slipping and smearing of ink as it is transferred from one surface to another.

Furthermore, high speed operations increase shock loading, which occurs when the edges of the gap contact the adjoining printing plate. This repetitive impact causes the cylinder and the mounted blanket to bounce, causing the ink to streak and increasing wear on both the blanket and the cylinder.

Shock loading can be reduced by making the cylinder gap as narrow as possible. Conventional cylinder gap widths, i.e., for use with fabric backed blankets, range from about 5 mm to about 10 mm in width. Another type of printing blanket known in the art is referred to as a metal-backed blanket (see, e.g., International Publication No. WO 93/01003 of Pinkston et al.) which rest upon and are supported by, a thin metal sheet. Metal-backed blankets can be mounted on cylinders with gaps that are less than 3 mm wide, as will be explained shortly. Blanket cylinders having these much-narrower gaps can operate at high speeds with a reduced incidence of shock loading.

A metal-backed printing blanket typically comprises a base layer of a thin, flat, flexible sheet of metal and a top layer comprising an elastomer such as rubber. Other layers may be sandwiched between the base and top layers, formed of materials such as fabric, after which these multiple layers are laminated together. Such a blanket conventionally has a thickness of about 2 mm, of which about 0.20 mm may be attributed to the thickness of the metal base plate.

One configuration of a metal-backed blanket manufactured and sold by KBA (Koenig & Bauer-Albert AG, of Frankenthal, Germany) has a small strip of exposed metal at the leading and trailing edges of the blanket adapted for insertion into the cylinder gap. Because the thickness of the metal edges is much less than the thickness of the rest of the blanket, the edges may be inserted into a cylinder gap that is much narrower than the gap that is needed to accommodate the thickness of more conventional blankets. The use of a much narrower cylinder gap (known as a "minigap") enables high-speed rotation with lower shock loading than that which is experienced when the cylinder has a more conventional, i.e., wider gap.

Despite the advantages of such minigap technology, the type of prior art blanket described above has a serious drawback: during operation, a metal edge may occasionally pull out from the cylinder gap, i.e., a phenomenon known as "blanket pull-out". The result can be catastrophic, because the unsecured blanket may damage or destroy neighboring machinery, rip the web, and/or cause complete shutdown of the printing press. Costly repair, replacement and down-time expenses are therefore incurred.

The present invention overcomes this serious limitation while retaining all the advantages of minigap technology, and the invention may be used without modification to existing offset printing machinery.

SUMMARY OF THE INVENTION

An improved metal-backed printing blanket for use in offset printing has now been developed which substantially overcomes the drawbacks of the prior art blankets discussed above.

A first embodiment of the invention relates to a compressible, elastomeric printing blanket comprising a metal base plate that has leading and trailing edges adapted for secure engagement in the cylinder gap. The top surface of one or both metal edges is provided with an anti-slip layer of a material that has a higher coefficient of friction than that of the base plate, to facilitate the retention of the base plate ends within the gap during rotation of the cylinder. The anti-slip layer, which may be comprised of an elastomeric material, has a thickness sufficient to permit insertion of the base plate edges and ends into the cylinder gap.

An advantage of the invention is that it may be used on cylinders with cylinder gaps that are much narrower than conventional gaps, to reduce the effects of vibration and shock loading while minimizing the risks of damage and/or loss caused by blanket pull-out.

Another advantage of the invention is that it may be used on existing cylinders that use minigap technology, without requiring any modification to the cylinder or mounting hardware.

A feature of the invention is to provide a terminal portion at the ends of the leading and trailing edges that does not include the anti-slip layer to facilitate insertion of the edges into the gap. The terminal portion has a length which is typically less than 10% of the distance between the leading or trailing edge of the base plate and the compressible blanket.

Another feature of the invention is to place a sealant along the edges of the compressible blanket at one side of the anti-slip layer to prevent entry of liquids such as ink and washing fluids into the layers or "plys" of the blanket. An additional feature of the invention is that the metal base plate may be coated with a primer that assists in bonding the compressible blanket to the base plate. In addition, the underside of the blanket may be at least partially coated with an elastomeric adhesive that assists in bonding the blanket to the primer coating. Each anti-slip layer may thus comprise at least part of the primer coating and part of the elastomeric adhesive.

Yet another feature of the invention is that the blanket may be comprised of a compressible layer and two fabric layers, wherein one fabric layer is sandwiched between the upper face and the compressible layer to stabilize the interface between the compressible layer and the printing face. The other fabric layer is located between the compressible layer and the base plate to reduce shear stresses on the compressible layer.

Another embodiment of the invention is a method of making a printing blanket for mounting on a cylinder that has a cylinder gap. The method comprises applying an elastomeric printing blanket on the top surface of a metal base plate that has leading and trailing edges adapted for engaging the cylinder gap. The method also includes providing an anti-slip layer upon at least a portion of the top surface of one or both ends of the base plate. The anti-slip layer has a coefficient of friction that is greater than that of the base plate and a thickness sufficient to permit insertion of the base plate edges and ends into the cylinder gap. The anti-slip layer facilitates the retention of the base plate ends within the gap during rotation of the cylinder.

A feature of this method is to provide a terminal portion on each end of the base plate that does not include the anti-slip layer, to facilitate insertion of the edges into the cylinder gap. The terminal portion is less than 10% of the distance between the leading and trailing edges of the base plate and the compressible blanket.

The method may be accomplished by first applying the elastomeric printing blanket upon a metal base plate that has been coated with a primer that adheres to metal and facilitates bonding between metal and fabric. The blanket's leading and trailing edges are positioned adjacent to but spaced from the leading and trailing edges of the primer-coated base plate. Then a portion of the leading and trailing edges of the blanket may be removed until only a thin coating of elastomer remains on the leading and trailing ends of the base plate. The thin coating of elastomer and primer on each metal edge forms the anti-slip layer.

A variation of this method is to apply the elastomeric printing blanket over the entire base plate except for its leading and trailing edges. An anti-slip layer of material with a coefficient of friction that is higher than that of the metal base plate is thereafter applied to the edges to form the anti-slip layer.

An additional feature of this method is to seal the edges of the blanket to prevent entry of liquids therein.

A further embodiment of the invention is to provide a method for securing a metal-backed printing blanket to a cylinder that includes a gap such that the leading and trailing edges of the blanket have a coefficient of friction that facilitates the retention of the edges in the cylinder gap during printing operations.

An advantage of this method is that it uses existing blanket cylinder technology with spring-loaded clamping means for holding the edges of a printing blanket inside a cylinder gap.

A feature of this method is that the anti-slip-coated edges are bent to angles that facilitate insertion of the edges into the cylinder gap and enable the mounted printing blanket to lay flat against the cylinder.

Other objects, advantages, features, uses and details of this invention will become apparent from the embodiments thereof presented in the following specification and claims, as well as in the enclosed drawings.

DETAILED DESCRIPTION OF THE PREFERRED EMBODIMENTS

Figure 1:
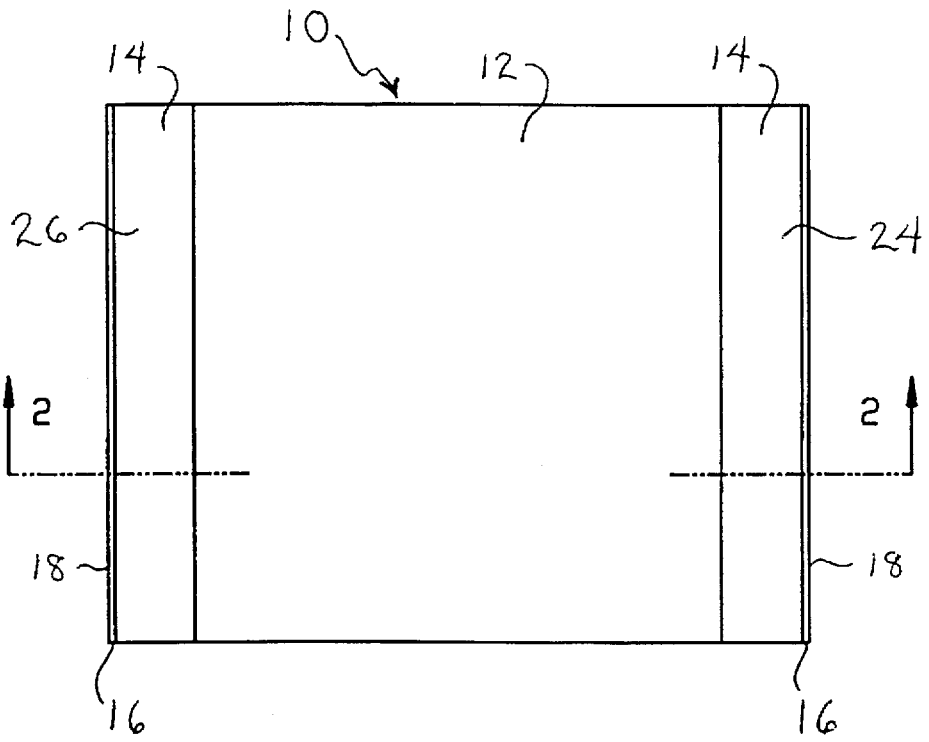
FIG. 1 is a top view of the invention, showing the printing blanket lying completely flat.
Figure 2:
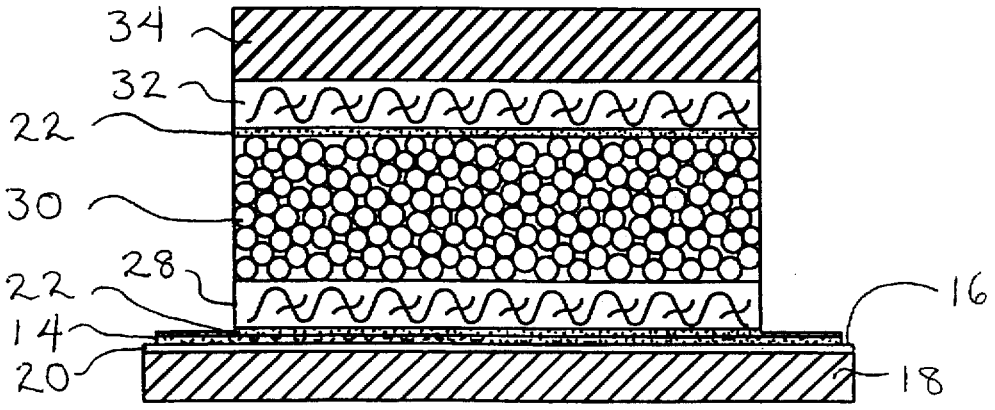
FIG. 2 is a partial sectional view, greatly enlarged, through the metal-based printing blanket manufactured according to a preferred embodiment of the invention.

FIG. 1 illustrates an embodiment of the printing blanket 10 of the present invention, which shows generally the compressible printing blanket 12, the anti-slip layer 14, and the terminal portion 16 of the metal base plate 18, lying in a flattened position. For convenience of understanding the invention, FIG. 2 provides a greatly exaggerated cross-sectional view of the blanket 10 showing the different layers of a preferred embodiment of the invention. These layers, together with their associated features, will be discussed below in turn.

For purposes of the present discussion, the terms "bottom" and "lower" and the like are used to refer to that portion of an individual layer or set of layers that is most nearly adjacent to the cylinder upon which the blanket of the present invention is mounted. Conversely, the "top" or "upper" portion of an individual layer or set of layers is that portion thereof which is located or positioned furthest from the printing cylinder.

The lowermost layer of blanket 10 is the metal base plate 18, which is formed of a thin sheet metal that has been cut in a rectangular shape from a roll of metal. The thickness of the base plate is preferably between 0.05 mm and 1 mm, and most preferably approximately 0.2 mm to ensure sufficient flexibility. Although stainless steel is a preferred metal for the base plate for purposes of fatigue resistance, high elastic modulus, etc., the invention is not limited to the use of stainless steel for forming the metal base plate.

In a preferred embodiment of the invention, the metal base plate 18 is at least partially coated with a primer layer 20 that facilitates bonding of the base plate 18 to the underside of the compressible printing blanket 12. Before primer 20 is applied to metal base plate 18, the top surface of the plate 18 should be cleaned and polished to make the metal flat and to remove grease and oxides for better adhesion. The primer should be a material that is capable of adhering to metal and fabrics. A variety of such materials are well known to those of ordinary skill in this field. A nonlimiting example of a primer that has been found to be particularly useful on base plate 18 is CILBOND 11, produced by Compounding Ingredients Limited, of Preston, England.

The cross-sectional view of FIG. 2 shows the anti-slip layer 14 above the primer layer 20 on metal base plate 18. The metal base as a coefficient of friction that would be well known to one of ordinary skill, depending on the metal used. The anti-slip layer 14 has a higher coefficient of friction than that of the metal and is preferably a compounded nitrile rubber. Alternate materials, including other elastomers, may be used for the anti-slip layer as long as they are capable of increasing the coefficient of friction of the top surface of the blanket's leading and/or trailing edges. Moreover, because solvents typically are used to clean printing machinery, the anti-slip layer should be solvent-resistant to maintain friction characteristics.

Anti-slip layer 14 is preferably formed after the compressible printing blanket 12 has been bonded to metal base plate 18 with primer layer 20 and adhesive 22. In this preferred embodiment after substantially all of the top surface of plate 18 is covered with blanket 12, the leading and trailing edges of blanket 12 are ground down through at least part of the adhesive 22 that binds blanket 12 and base plate 18 together. Thus, when anti-slip layer 14 is formed in this manner, it comprises a portion of adhesive layer 22, as well as, optionally, some of primer 20 as illustrated in FIG. 2. Alternate method(s) of forming the anti-slip layer are described below.

Adhesive 22 shown in FIG. 2 bonds the compressible printing blanket 12 or "carcass" to the metal base plate. As noted above, the adhesive 22 may be ground down to form anti-slip layer 14 and is preferably a compounded nitrile rubber, but other elastomers may be used, such as acrylic, urethane, neoprene and fluorocarbon elastomers, if desired.

In a preferred embodiment of the invention, fabric layer 28 forms the lowermost ply of the compressible printing blanket 12. Fabric layer 28 is preferred as a means of reducing shear stresses that develop at the interface between the compressible printing blanket 12 and metal base plate 18. Shear stresses arise during operation of the press because the printing blanket is compressed at the nip or print zone between the blanket cylinder and the rigid plate cylinder. At the center of the nip, the blanket is depressed by the cylindrical contour of the printing plate. In the proximate vicinity of the nip, a bulge tends to arise in the printing blanket. Compressible layers have been developed for use in such blankets which minimize the bulges that occur. Nevertheless, bulging and depression of the blanket in the print zone, when present, results in expansion and compression of the printing blanket 12. Such compression and expansion cause shear stresses at the interface between the printing blanket 12 and the base plate 18, because the blanket's compressible layer 30 is far more elastic than the metal base plate 18. Shear stresses have a tendency to cause the printing blanket 12 to delaminate from the metal base plate 12. Fabric layer 28 reduces this tendency. The embodiment described herein, having one fabric layer below compressible layer 30, should not be viewed as limiting the invention since additional fabric layers may be incorporated at this location if desired for a particular application.

Fabric layer 28 may be formed of natural or synthetic material or may be a natural/synthetic blend of an appropriate length and thickness (also referred to as "gauge"). Cotton, polyester, nylon and rayon are typical materials that are commonly used in fabric layers of printing blankets. The thickness of fabric layer 28 ranges between approximately 0.1 mm and 0.4 mm and is most preferably approximately 0.2 mm.

Above fabric layer 28 in FIG. 2 is compressible layer 30 which enables the blanket 12 to compress under pressure exerted at the two areas where the printing cylinder and impression cylinder contact the printing blanket, to prevent bulging and thus to enhance print quality. Compressible layer 30 comprises a plurality of cells embedded in a binder. Such cells resist the greater and more permanent deformation within blanket 10 that would occur in the absence of such a layer. The binder in which the cells are embedded is made from a suitable resilient polymer matrix, into which a quantity of cell-forming materials are evenly dispersed to form a compound. The cells may be open, e.g., formed by salt leaching; or they may be closed, e.g., formed with the use of, e.g., blowing agents or microspheres. Microspheres, which are the preferred cell-forming material for use in the present invention, are dispersed relatively uniformly throughout the matrix material such that, upon application of the matrix to fabric layer 28, the microspheres become thoroughly embedded in the interstices of the fabric.

Generally, the microspheres are formed from materials such as, e.g., thermoplastic resins, thermosetting resins, ceramics, glass and sintered metals. A preferred thermosetting resin for forming the microspheres used in the invention is a phenolic resin having a density of between about 0.01 and 0.05 grams per cubic centimeter. The microspheres range in diameter between about 1–200 and preferably 50–130 microns, with an average size of about 90 μ being most preferred.

Generally, the microspheres are uniformly distributed throughout the elastomer in such a way as to avoid any appreciable crushing of the microspheres. Additionally, the microspheres are incorporated in the elastomeric material at a loading of about 4–90% and preferably 10–70% of the solid contents. This percentage will vary based on such factors as microsphere dimension, wall thickness and bulk density, or if blowing agents are additionally incorporated within the matrix.

To form the cells in the embodiment described above, any of a wide variety of microspheres can be added to a solution or dispersion of the matrix. If solvent solutions are utilized, the selected microspheres must be resistant to chemical attack from the solvents.

Several acceptable types of thermoplastic microspheres for use with the present invention are marketed, for example, by Expancel and Pierce & Stevens. Microspheres of a thermoplastic resin are preferred for this embodiment.

FIG. 2 illustrates the presence of an adhesive 22 between compressible layer 30 and fabric layer 32. Adhesive 22 may be applied to compressible layer 30 and fabric layer 32 before these layers are laminated together. Alternatively or additionally this bonding may be effected by a chemical reaction that occurs between compressible layer 30 and fabric layer 32 during the curing process, as is well known in the art. The adhesive is typically nitrile rubber, as described earlier.

A preferred embodiment of the invention has one or more fabric layers such as fabric layer 32 positioned in between compressible layer 30 and the printing face, or upper printing face 34. This top fabric layer 32 or fabric layer stack serves to stabilize the interface between compressible layer 30 and upper printing face 34 during printing operations. Upper printing face 34 is comprised of an elastomeric compound which is adapted to accept the print image from the printing plate and transfer it to a substrate such as paper. Upper face 34 may be buffed to a desired surface roughness profile in a known manner to improve print quality and to facilitate release of the web.

To make the printing blanket 10 according to a preferred mode of the invention, fabric layer 28 is first coated by spreading with an elastomeric compound such as nitrile rubber to form compressible layer 30 atop fabric layer 28. The elastomer coated fabric is cured according to conventional methods, such as festooning, and is then buffed or ground to a desired thickness between 0.5 mm and 1.0 mm, preferably, 0.6 mm to 0.7 mm, most preferably about 0.66 mm. Adhesive, e.g., nitrile rubber, may be spread over the top of compressible layer 30 to adhere an additional fabric layer 32. Additional adhesive (e.g., nitrile rubber) is spread on the bottom surface of another layer of fabric 32, which is laminated on top of compressible layer 30. Elastomeric printing face 34 is applied to the top of the carcass, which is then cured and ground again, so that the thickness of upper face 34 ranges from approximately 0.2 mm to 0.5 mm, preferably 0.3 mm to 0.4 mm and most preferably about 0.35 mm thick. The bottom of the carcass 12, after curing, is spread with nitrile rubber adhesive to facilitate attachment to the metal base plate through the primer layer placed thereupon.

Meanwhile, metal base plate 18 is cut to the desired dimensions and polished on its upper surface to remove oxides and grease. The top surface is coated with a primer 20 that aids in bonding metal to elastomeric material. Metal plate 18 is then squeezed or laminated to the prepared carcass of compressible printing blanket 12. The preferred thickness of the entire blanket 10 ranges between approximately 1 mm and 3 mm, preferably 1 mm to 2 mm and most preferably about 1.61 mm.

To form anti-slip layer 14 according to a preferred mode of the invention, the edges of compressible printing blanket 12 near leading and trailing edges 24 and 26 of plate 18 are ground down until a very thin layer of cured adhesive remains on edges 24 and 26. In an alternate embodiment, however, the leading and trailing edges of plate 18 may initially be left bare. Anti-slip layer 14 may thereafter be added to the exposed metal edges 24 and 26, e.g., by spraying or brushing onto the edges, optionally with an adhesive, after the carcass 12 and metal base plate 18 are laminated together.

Figure 3:
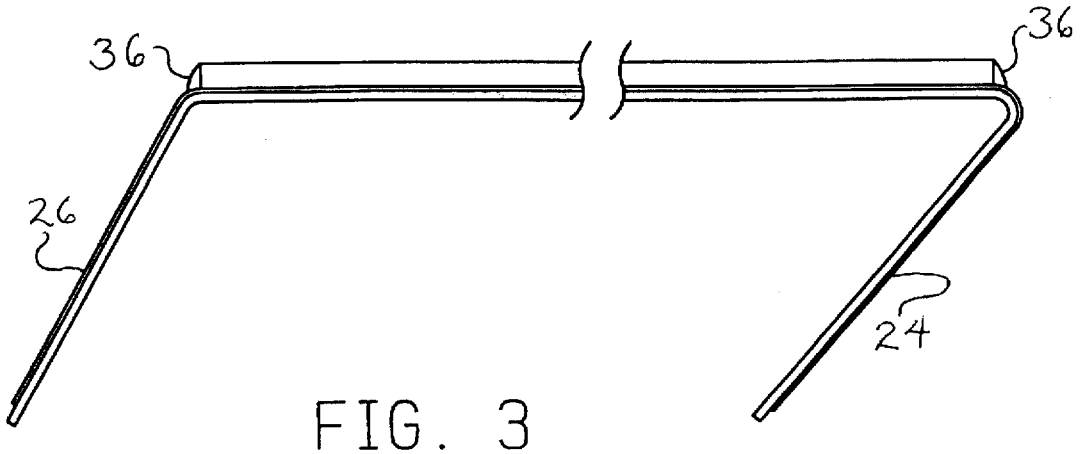
FIG. 3 is a schematic side view of the printing blanket showing leading and trailing edges bent at an appropriate angle for inserting into the cylinder gap prior to mounting the blanket on a cylinder.
Figure 4A:
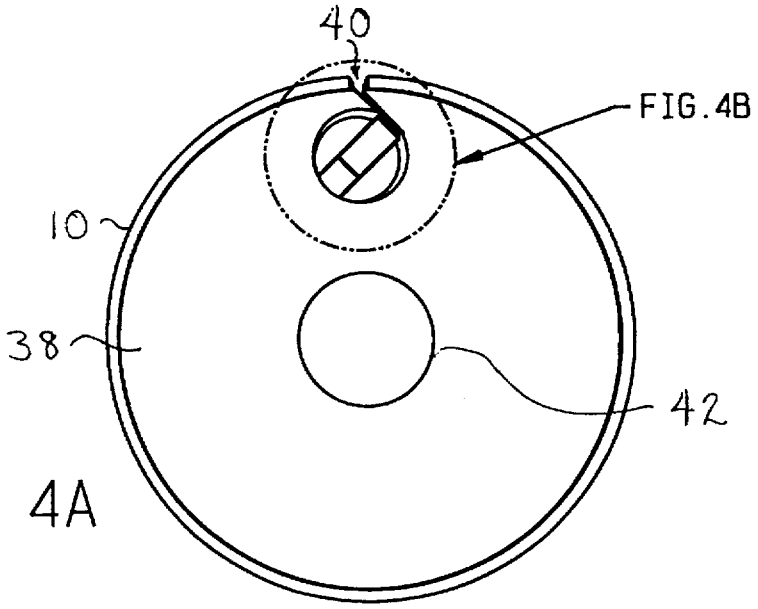
FIG. 4A is a schematic view of the printing blanket mounted on a cylinder with a cylinder gap.
Figure 4B:
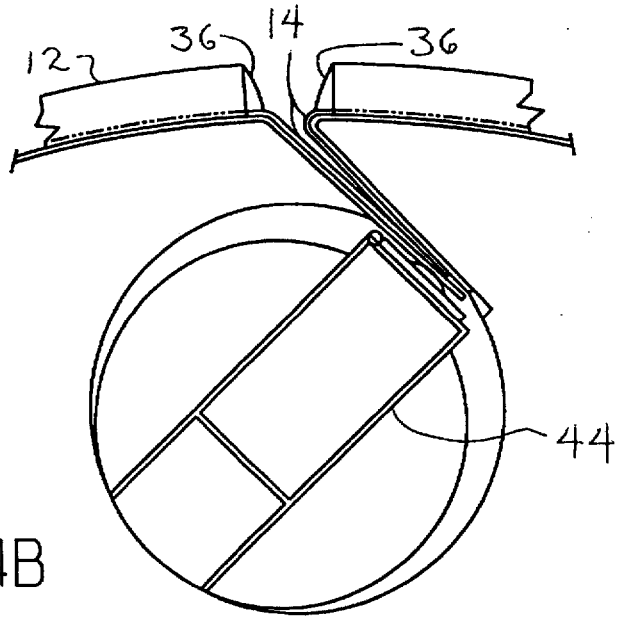
FIG. 4B is a cross-sectional detail showing the leading and trailing edges of the printing blanket inserted into the cylinder gap.

Turning to FIG. 3, in a further embodiment, sealant 36 is applied along the edges of blanket 12 between the blanket and bare edge to keep various fluids such as ink, water and solvents typically encountered in a printing environment from penetrating the multiple layers of the blanket 12 and causing swelling and delamination of the various layers. The sealant should be resistant to such solvents, including those used for cleaning the blanket, and is preferably a nitrile polymer such as EC 776, produced by 3M. Other materials that may be used as sealants include but are not limited to acrylic polymers, fluorocarbon polymers, urethane polymers, cyanoacrylate polymers, epoxy polymers or other solvent-resistant polymers and mixtures thereof.

Terminal portion 16 of blanket 10 is preferably formed by covering the ends of edges 24 and 26 with adhesive tape before primer 20 is applied to the upper surface of metal plate 18. The tape prevents primer from coating the sides and/or bottom of plate 18 during application of the primer. The tape is removed after anti-slip layer 14 is formed or applied, leaving a narrow edge 16 that is less than 10% of the distance between the leading or trailing edges of base plate 18 and compressible blanket 12. The smooth metal edges of terminal portions 16 facilitate the insertion of leading and trailing edges 24 and 26 into the cylinder gap.

Again with reference to FIG. 3, to secure printing blanket 10 to a blanket cylinder, the printing blanket is first produced according to the process described above. Leading and trailing edges 24 and 26, respectively, are then bent as shown generally in FIG. 3, so that they are properly oriented for insertion into the cylinder gap. The angles through which edges 24 and 26 are bent vary according to the angle at which the cylinder gap extends into the blanket cylinder. Leading edge 24, for example, may be bent at an angle of less than 90° from the underside of blanket 10. This acute angle is preferably between 15° and 70°, more preferably between 30° and 60°, with the most preferable angle being about 45°. Trailing edge 26 is also bent so that it forms an angle of greater than 90° from the underside of blanket 10. This obtuse angle preferably ranges between 110° and 165°, more preferably between 120° and 150°. The most preferred angle is about 135°.

Once leading and trailing edges 24 and 26 are properly oriented, printing blanket 10 is ready for mounting on the blanket cylinder 38 which rotates about spindle 42 by conventional methods for metal-backed blankets. The blanket 10 is wrapped around the cylinder such that the upper surface of leading and trailing edges 24 and 26 of the blanket face each other. Leading and trailing edges 24 and 26 are inserted into cylinder gap 40 wherein they may be pressed together by (optional) conventional spring-loaded clamping means 44. Anti-slip layers 14 abut each other inside the cylinder gap 40 and reduce slippage between leading and trailing edges 24 and 26 during operation.

It is noted that the above description is merely illustrative of the invention, and other parameters and embodiments may be used without departing from the inventive concept herein. Accordingly, the present invention is only limited by the claims appended hereto.

What is claimed is:

1. A metal-backed printing blanket for mounting on a cylinder that includes a gap, comprising:

a metal base plate having top and bottom surfaces and ends which include leading and trailing edges adapted for engaging the cylinder gap;

a compressible, elastomeric printing blanket secured to the top surface of the base plate but not the ends and having an upper face adapted for contact transfer of ink to a printable substrate; and an anti-slip layer provided upon at least a portion of the top surface of at least one end of the base plate to facilitate the retention of the base plate ends within the gap during rotation of the cylinder;

wherein the anti-slip layer has a coefficient of friction that is greater than that of the base plate and a thickness sufficient to permit insertion of the base plate edges and ends into the cylinder gap.

2. The metal-backed printing blanket according to claim 1, wherein an anti-slip layer is provided upon at least a portion of the top surface of each end of the base plate, with the anti-slip layers facing each other when the base plate ends are positioned in the cylinder gap to provide more secure retention of the base plate ends within the gap during rotation of the cylinder.

3. The metal-backed printing blanket according to claim 2, wherein the blanket includes leading and trailing edges positioned adjacent to the leading and trailing edges of the base plate, and each end of the base plate includes a terminal portion that does not include the anti-slip layer to facilitate insertion of the edges into the gap, where each terminal portion has a length which is less than ten percent of the distance between the leading and trailing edges of the base plate and blanket.

4. The metal-backed printing blanket according to claim 3, further comprising a sealant along the edges of the blanket to prevent entry of liquid therein.

5. The metal-backed printing blanket according to claim 4, wherein the sealant is a material selected from the group consisting of nitrile polymers, acrylic polymers, fluorocarbon polymers, urethane polymers, cyanoacrylate polymers, epoxy polymers and mixtures thereof.

6. The metal-backed printing blanket according to claim 1, wherein the anti-slip layer comprises an elastomeric material.

7. The metal-backed printing blanket according to claim 2, wherein the base plate has a primer coating that assists in bonding the blanket to the base plate, and the blanket includes an bonding the adhesive that assists in bonding the blanket to the primer coating, and each anti-slip layer comprises at least part of the primer coating and part of the elastomeric adhesive.

8. The metal-backed printing blanket according to claim 1, wherein the blanket includes a compressible layer beneath the upper face and at least one fabric layer, and wherein the base plate has a primer coating that assists in bonding the blanket to the base plate.

9. The metal-backed printing blanket according to claim 8, wherein the blanket has a compressible layer and first and second fabric layers, the first fabric layer being located between the upper face and the compressible layer to stabilize an interface between the upper face and the first fabric layer, and the second fabric layer being located between the compressible layer and the base plate to reduce shear forces on the compressible layer.

10. A method of making a printing blanket for mounting on a cylinder that includes a gap, which comprises:

applying an elastomeric printing blanket upon a metal base plate that has top and bottom surfaces and ends which include leading and trailing edges adapted for engaging the cylinder gap; and providing an anti-slip layer upon at least a portion of the top surface of at least one end of the base plate, the anti-slip layer having a coefficient of friction that is greater than that of the base plate and a thickness sufficient to permit insertion of the base plate edges and ends into the cylinder gap to facilitate the retention of the base plate ends within the gap during rotation of the cylinder.

11. The method according to claim 10, which further comprises providing an anti-slip layer upon at least a portion of the top surface of each end of the base plate, with each anti-slip layer having a thickness sufficient to permit insertion of the base plate edges and ends into the cylinder gap.

12. The method according to claim 11, wherein the blanket includes leading and trailing edges positioned adjacent to but spaced from the leading and trailing edges of the base plate, and which further comprises providing a terminal portion that does not include the anti-slip layer on each end of the base plate to facilitate insertion of the edges into the gap, where each terminal portion has a length which is less than ten percent of the distance between the leading and trailing edges of the base plate and blanket.

13. The method according to claim 11, wherein the blanket includes leading and trailing edges positioned adjacent to the leading and trailing edges of the base plate, and which further comprises removing a portion of the leading and trailing edges of the blanket for providing the anti-slip layer on the ends of the base plate.

14. The method according to claim 13, which further comprises sealing the edges of the blanket to prevent entry of liquids therein.

15. A method of securing a metal-backed printing blanket to a cylinder that includes a gap, which comprises:

providing a metal-backed printing blanket according to claim 1;

orienting the leading and trailing edges of the base plate for insertion into the cylinder gap; and mounting the metal-backed printing blanket on the cylinder with the leading and trailing edges of the base plate inserted into the cylinder gap.

16. The method according to claim 15, which further comprises providing an anti-slip layer upon at least a portion of the top surface of each end of the base plate, with each anti-slip layer having a thickness sufficient to permit insertion of the base plate edges and ends into the cylinder gap; and pressing the base plate ends together to increase contact force between the anti-slip layers.

17. The method according to claim 16, which further comprises:

bending the leading edge and end of the base plate to an angle of greater than 15° and less than 90° with respect to the base plate;

bending the trailing edge and end of the base plate to an angle of greater than 90° and less than 165° with respect to the metal base plate; and inserting the bent edges and ends into the cylinder gap.

18. The method according to claim 17, which further comprises:

bending the leading edge and end of the base plate to an angle of greater than 30° and less than 60° with respect to the base plate;

bending the trailing edge and end of the base plate to an angle of greater than 120° and less than 150° with respect to the metal base plate; and inserting the bent edges and ends into the cylinder gap.

19. A method of securing a metal-backed printing blanket to a cylinder that includes a gap, which comprises:

making a metal-backed printing blanket according to claim 10;

orienting the leading and trailing edges of the base plate for insertion into the cylinder gap; and mounting the metal-backed printing blanket on the cylinder with the leading and trailing edges of the base plate inserted into the cylinder gap.

20. The method according to claim 19, which further comprises providing an anti-slip layer upon at least a portion of the top surface of each end of the base plate, with each anti-slip layer having a thickness sufficient to permit insertion of the base plate edges and ends into the cylinder gap; and pressing the base plate ends together to increase contact force between the anti-slip layers.

21. The method according to claim 20, which further comprises:

bending the leading edge and end of the base plate to an angle of greater than 15° and less than 90° with respect to the base plate;

bending the trailing edge and end of the base plate to an angle of greater than 90° and less than 160° with respect to the metal base plate; and inserting the bent edges and ends into the cylinder gap.

22. The method according to claim 20, which further comprises:

bending the leading edge and end of the base plate to an angle of greater than 30° and less than 60° with respect to the base plate;

bending the trailing edge and end of the base plate to an angle of greater than 120° and less than 150° with respect to the metal base plate; and inserting the bent edges and ends into the cylinder gap.

* * * * *